United States Patent [19]

Brodbeck

[11] 3,980,079

[45] Sept. 14, 1976

[54] MASSAGING AND RELAXING DEVICE

[76] Inventor: Brunhilde Brodbeck, 1440 Poplar Ave., Memphis, Tenn. 38104

[22] Filed: Dec. 2, 1975

[21] Appl. No.: 636,980

Related U.S. Application Data

[62] Division of Ser. No. 511,981, Oct. 4, 1974, Pat. No. 3,934,579.

[52] U.S. Cl. ..... 128/57

[51] Int. Cl.[2] ..... A61H 15/00

[58] Field of Search ..... 128/57, 24.3, 60, 67, 128/59

[56] References Cited

UNITED STATES PATENTS

| | | | |
|---|---|---|---|
| 1,585,767 | 5/1926 | Clarke | 128/57 |
| 2,248,525 | 7/1941 | Fleissner | 128/60 |

FOREIGN PATENTS OR APPLICATIONS

| | | | |
|---|---|---|---|
| 16,783 | 8/1899 | United Kingdom | 128/57 |

*Primary Examiner*—Lawrence W. Trapp
*Attorney, Agent, or Firm*—Hill, Gross, Simpson, Van Santen, Steadman, Chiara & Simpson

[57] ABSTRACT

Muscle toning apparatus that can be used by one or more individuals to tone the muscles of a single person as passed back and forth under varying pressures, to relieve and stimulate tired muscles.

6 Claims, 2 Drawing Figures

MASSAGING AND RELAXING DEVICE

This a division of application Ser. No. 511,981, filed Oct. 4, 1974, and now U.S. Pat. No. 3,934,579.

BACKGROUND, SUMMARY AND ADVANTAGES OF INVENTION

Muscle toning apparatus have heretofore been generally disclosed in such patents as the U.S. Pat. Nos. to Rohrer 1,014,774, Clarke 1,585,767 and Belleville 2,578,916, which operate on the principle of relieving tissue and muscle tension as passed back and forth along the body. While some of these tension relievers are particularly made to generally conform to parts of the body, they are mostly stiff and unwieldy and do not perform an efficient massaging operation.

The present invention improves upon the massaging devices of the foregoing references by providing a relatively flexible, freely movable relaxer or exerciser, which may conform to various parts of the body and perform a muscle toning or relaxing function without discomfort to the body.

An advantage of the present invention is that the relaxer is sufficiently flexible and freely movable to relax the body tissues and relieve tension by a slow toning motion along the desired parts of the body.

A further advantage of the invention is that the massaging device may readily relieve tension from various parts of the body by exerting a free rolling motion along the tense muscular portions of the body.

A still further advantage of the invention is that the apparatus and its operation is so simple and requires so little physical effort that it may be operated by a confined person, such as a semi-invalid.

A still further advantage of the invention is the provision of an exercising apparatus and device producing a vigorous kneading motion, stimulating the skin and underlying tissues without damage to the skin and, at the same time, producing a soft and relaxing massaging action to dispel tension or fatigue.

Still another advantage of the invention is to massage on the principle of kneading or massaging with beads or rollers and to arrange the kneading or massaging rollers and support therefor to make it easy to manipulate the rollers over the throat, neck and shoulder muscles and particularly at the base of the skull on the back of the neck.

A still further advantage of the invention is to provide a massaging device utilizing rotating beads to effect a massaging operation and to so size the beads as to avoid undesirable stretching of the skin and muscle tissue and to allow more pressure to be exerted where required over relatively long periods of time without discomfort.

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure.

DESCRIPTION OF A PREFERRED EMBODIMENT

Figure 1:
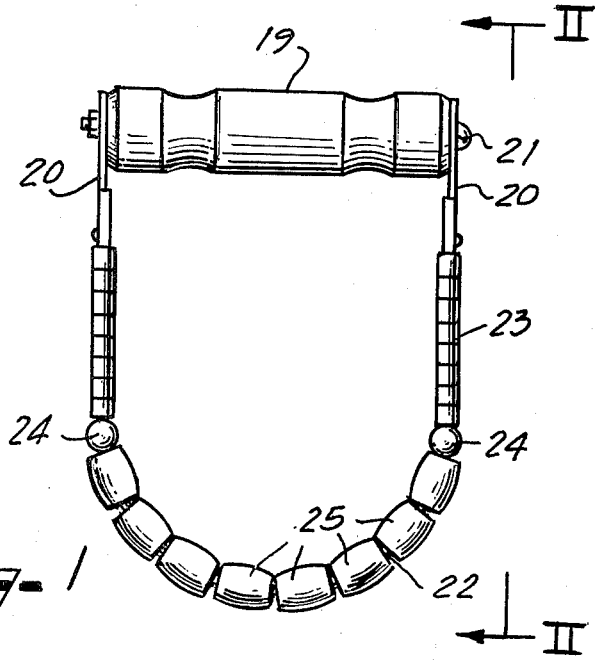
FIG. 1 is a view in side elevation of a form of exercising device constructed in accordance with the principles of the present invention.
Figure 2:
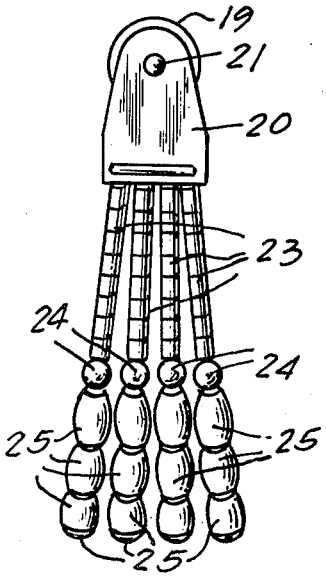
FIG. 2 is a view in side elevation of the device shown in FIG. 1.

In FIGS. 1 and 2 of the drawings, the massager is designed for readily relaxing and massaging parts that are difficult to reach. The massager or muscle toner is particularly useful for reducing a double chin and tightening flabby muscles. It is also useful on the forehead from temple to temple, with a slow motion for relaxing the nerves and can be used in bed as a tranquilizer to help put a person to sleep, due not only to backward and forward motion of the massager over the forehead, but the slight rolling rhythm of the balls and beads. This form of the invention has a single handle 19 and may be said to be of a potato-masher-type. The handle 19 has brackets 20 secured to its opposite ends, as by a machine screw 21. The brackets 20 may be bent over a series of wires 22 crimped thereto and depending therefrom in the general form of a horse shoe and fan shape in side elevation. The wires 22 are shown as having a series of beads 23 strung thereon, generally cylindrical in form and terminating into lower bearing beads 24 at opposite ends of a series of elongated generally oval beads 25.

The rows of beads 23 and 25 are shown as flaring outwardly relative to the center of the machine screw 21 and also form an arc at their lower ends to provide a relaxer which may be rolled over various muscles and particularly adapted for use on the under and upper arm, to relax the muscles when tired. The device may be used above the elbow and from the wrist to the elbow for relaxing the arm muscles after heavy-duty work, and can readily be slipped over the ankle to relax the ankle and tired feet, particularly the soles of the feet after walking or standing. It further can also be used on the stomach or any muscle that can be reached, and is useful in rolling along the back of the neck between the shoulder blades and to be rolled over a patient when in a reclining position.

This massager is also useful for massaging and relaxing the neck as well as for reducing a double chin and tightening flabby muscles.

In the form of relaxer shown, the multiple freely movable rollers act like gently rippling waves over sore muscles and particularly tired feet. The device just described may also readily be rolled over and under the arch and around the ankle, to increase circulation where the muscles have been overworked and are painful.

With the device shown in FIGS. 1 and 2, the larger beads at the end or arch of the device allow more pressure to be exerted in a massage effort to increase the kneading effect beneficial to the muscles, and particularly those enduring long periods of strain or fatigue and the use of beads or rollers, rather than irregular devices having a tendency to roughen or tear up the skin, assures the avoidance of undesirable stretching of the skin and muscle tissue, which may be produced by improper massage manipulations and arrangements of other devices.

I claim as my invention:

1. In a massaging and relaxing device for stimulating and relaxing various parts of the body, a hand grip, a plurality of laterally spaced U-shaped wires having arch-shaped outer portions and connected at their opposite end portions to opposite ends of said hand grip, and a plurality of beads freely mounted on said wires for the length thereof to afford free massaging access to various parts of the body.

2. The massaging and relaxing device of claim 1, wherein at least the outermost of the wires flare outwardly from the axial center of the hand grip and with the innermost of said wires are of a fan-like shape in side elevation.

3. The massaging and relaxing device of claim 1, wherein all of the wires flare outwardly with respect to lines extending perpendicular to the center of the handle in a generally fan-shaped form and the beads on the arched portions of the wires are of an elongated oval shape.

4. The massaging and relaxing device of claim 1, in which the wires flare outwardly relative to each other in a generally fan-shaped form in side elevation, the beads extending along the arched portions of the wires are generally oval-shaped in form, the beads extending along the wires from the hand grip are generally cylindrical in form, and generally spherical beads separate the cylindrical beads from the generally oval-shaped beads.

5. The relaxer of claim 1 in which brackets are secured to opposite ends of the hand grip and have portions bent over the end portions of the series of generally U-shaped wires and crimped thereto in which the wires flare outwardly relative to each other and are fan-shaped in side elevation, wherein the wires have a series of beads strung thereon generally cylindrical in form and terminating into lower bearing spherical beads, wherein the spherical beads terminate into elongated generally oval beads extending along the arch-shaped portions of the wires.

6. The relaxer of claim 5 in which the generally oval and cylindrical beads flare outwardly relative to the axial center of the hand grip and the arch-shaped form of the wires and oval beads provide a relaxer which may be rolled over various muscles and particularly adapted for use on the under and upper portions of the arm and foot to relax the muscles when tired.

* * * * *